US005347715A

United States Patent [19]

Friedland

[11] Patent Number: 5,347,715

[45] Date of Patent: Sep. 20, 1994

[54] BLADE SHAVE COUNTER

[76] Inventor: Donald H. Friedland, 17 E. 31st St., New York, N.Y. 10016

[21] Appl. No.: 121,205

[22] Filed: Sep. 14, 1993

[51] Int. Cl.[5] ..... B26B 19/38

[52] U.S. Cl. ..... 30/41.7; 30/85

[58] Field of Search ..... 30/41.7, 34.05, 32, 30/85

[56] References Cited

U.S. PATENT DOCUMENTS 3,229,659 1/1966 Sciascia ..... 30/41.7

5,111,580 5/1992 Bosscha et al. ..... 30/41.7

5,240,107 8/1993 Casale ..... 30/41.7 X

*Primary Examiner*—Richard K. Seidel

*Assistant Examiner*—Hwei-Siu Payer

*Attorney, Agent, or Firm*—Kaplan and Mugno

[57] ABSTRACT

A blade shave counter is disclosed which counts the number of shaves for which an interchangeable shaving blade has been used, and displays the count on an LCD display mounted preferably on the shaving handle of a shaving instrument. Optionally, an audible alarm sounds or an LED is activated when the count reaches a predetermined or user selectable value.

18 Claims, 3 Drawing Sheets

BLADE SHAVE COUNTER

TECHNICAL FIELD

This invention relates to shaving instruments, and more particularly, to an improved shaving instrument that provides a technique for determining when a disposable blade connected thereto should be replaced.

DESCRIPTION OF THE PRIOR ART

Shaving instruments of all types and sizes are well known in the art. A typical such shaving instrument utilizes a shaving handle with disposable blades. Often these disposable blades are sold in multi-pack cartridges.

After a blade has been used numerous times and becomes dull, the blade is disengaged from the shaving handle and discarded. This disengagement is often accomplished by pressing a release button on the shaving handle which causes the blade to simply fall off of the shaving handle and into a wastebasket. A new blade is then snapped into place on the shaving handle.

The user knows when the blade should be replaced because during shaving, the user receives cuts and nicks due to the dullness of the old blade. When a poor shave and cuts and nicks are received, the user knows it is time to change the blade. However, without attempting to actually shave with the dull blade, there is no convenient technique for determining when to replace the blade.

In view of the above, it would be desirable to provide a technique for letting the user know that the old blade should be changed prior to the user receiving the poor shave or the cuts and nicks.

SUMMARY OF THE INVENTION

The above and other problems of the prior art are overcome in accordance with the present invention which relates to an apparatus for counting the number of shaves achieved with a particular replaceable blade. In accordance with the invention, a display, preferably of the Liquid Crystal Display (LCD) type, is mounted on the shaving handle. The shaving handle includes means for counting the number of shaves received from a replaceable blade.

When the number of shaves for which the replaceable blade has been utilized reaches a predetermined value, the user knows it is time to replace the blade. Alternatively, a small audible alarm 53 or Light Emitting Diode (LED 52) can be utilized which alerts the user that he is over the maximum number of shaves for which a single blade can be utilized without becoming dull. The user can then replace the blade prior to receiving the poor shave with nicks and cuts.

It is noted that the apparatus also provides a means for the user to get an idea of how many shaves he typically gets out of each blade.

DETAILED DESCRIPTION OF THE PREFERRED EMBODIMENT

Figure 1:
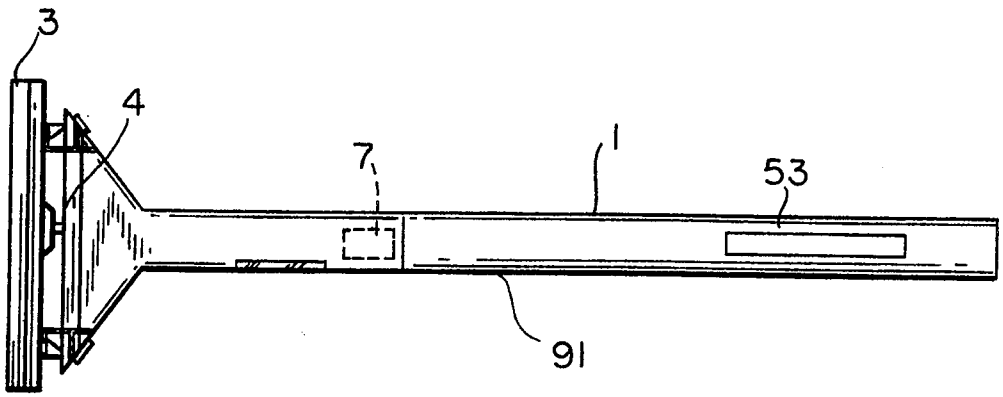
FIG. 1 shows a top view of a shaving instrument in accordance with the present invention.

FIG. 1 shows a top view of a shaving instrument 10 made in accordance with the teachings of the present invention. The shaving instrument includes a shaving handle 1 and a shaving blade 3. The shaving blade is disposable and replaceable.

The shaving instrument 91 includes a shaving handle 1 comprising a Liquid Crystal Display (LCD) 2 and a battery compartment with a battery 7 shown in dotted outline. The shaving blade 3 attaches to the shaving handle 1 via two clips 9.

Figure 2:
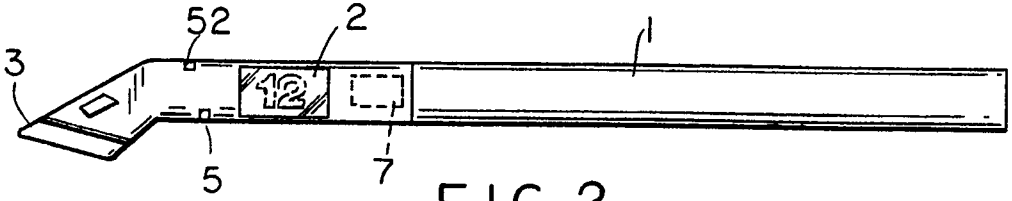
FIG. 2 shows a side view of a shaving instrument in accordance with the present invention.

When the new shaving blade 3 is attached to the shaving handle 1, a counter within shaving handle 1 is reset and the LCD display 2 returns to zero. Thereafter, each time the shaving instrument 91 is utilized to shave, the count displayed on the LCD display is incremented. Thus, the display always shows the total number of times that the shaving instrument 91 has been utilized. As shown in FIG. 2, the number 12 is displayed on the shaving handle 1 within the LCD display 2, indicating that the user has shaved twelve times.

Figure 3:
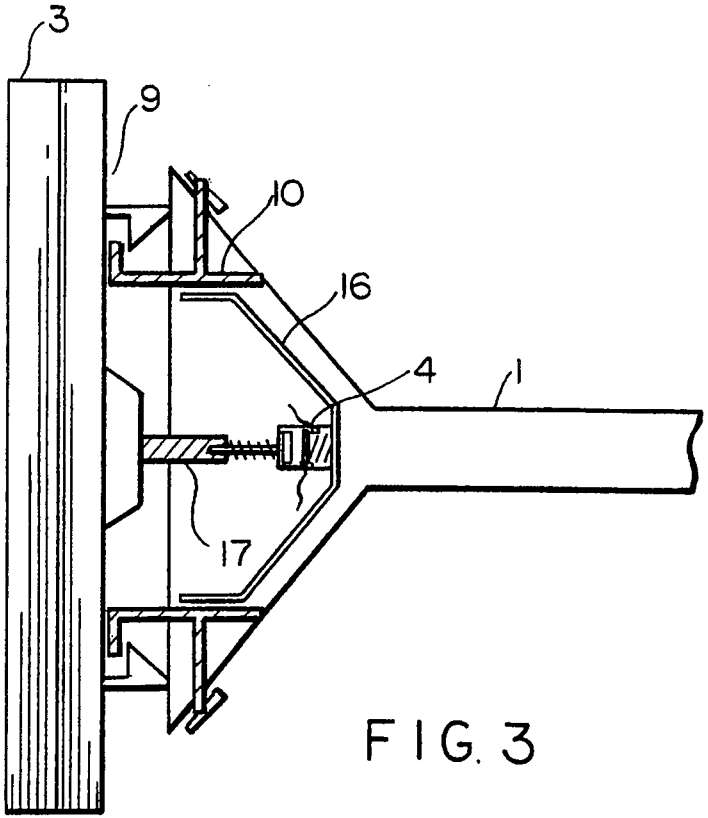
FIG. 3 shows an exploded view of a shaving blade connected to the top of the shaving handle in accordance with the present invention.

FIG. 3 shows an exploded view of the shaving blade 3 connected to the shaving handle 1. FIG. 3 also shows the details of a mechanical switching arrangement which may be employed to activate the electronics and reset to zero the counter which counts the number of shaves.

When the new shaving blade 3 is attached to the shaving handle 1, the clips 9 of the shaving blade 3 are engaged by the two catches 10 which are held apart by the resilience of a flat spring 16. This type of connection between the shaving handle and shaving blade is similar to what is known in the prior art.

Figure 4:
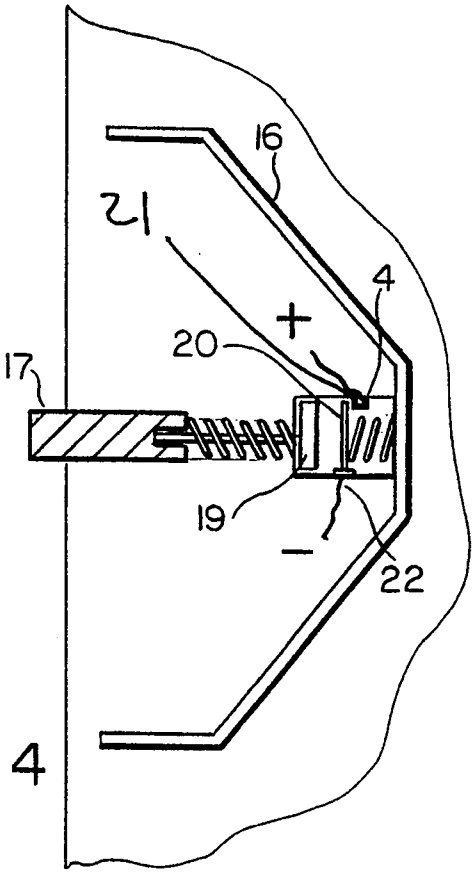
FIG. 4 depicts the mechanism within the shaving handle for resetting a counter to zero when the new shaving blade is installed.

With reference to FIG. 4, positive and negative terminals 21 and 22, respectively, are connected to the appropriate contact points on the battery 7. The actual connections are not shown in FIG. 4 for purposes of clarity. Conductive plate 20 is permanently attached to negative terminal 22 as shown, and is also flexible. It can be appreciated from FIG. 4, that when a shaving blade is attached to shaving handle 1, plunger 19 is forced against conductive plate 20 by the movement of the extension arm 17. The top of conductive plate 20 bends toward positive terminal 21. The conductive plate 20 contacts positive terminal 21 and forms an electrical connection between terminals 21 and 22. This connection completes the circuit and causes the LCD display to reset to zero.

In order to correctly count the number of shaves for which the blade is utilized, a technique to increment the counter each time the blade is used to shave is required and is described below. A circuit for performing this function is shown in FIG. 5.

Figure 5:
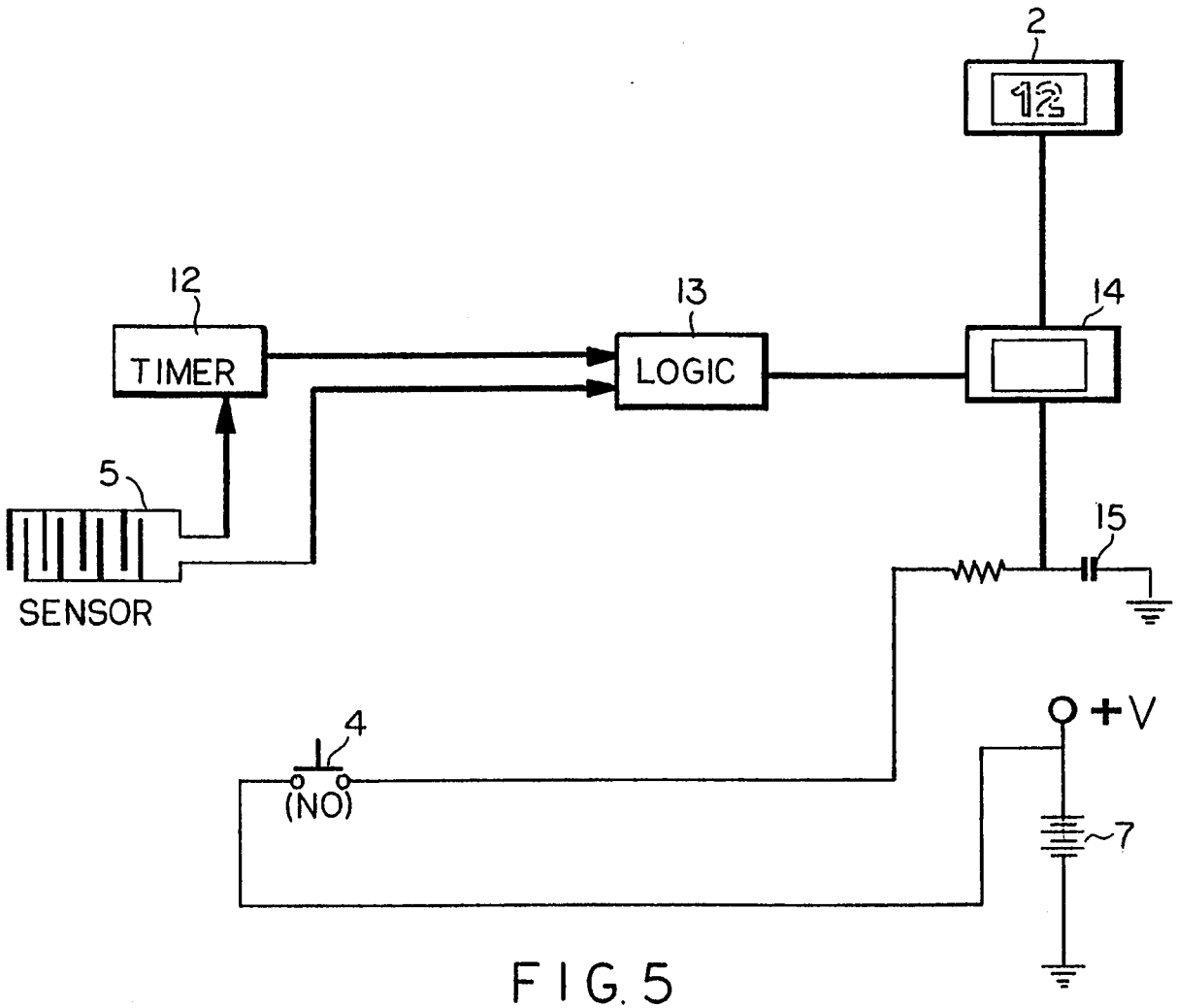
FIG. 5 is an electrical diagram of an exemplary circuit within the shaving handle for controlling the display.

A moisture sensor 5 which detects water is shown schematically in FIG. 5. Sensor 5 may be an ion detector, a resistance detector, or any of a number of other types of sensors which are known in the art and which can sense water. The detector includes sufficient electronics for asserting a binary "1" when the detector is wet, and a binary "0" when the detector is not wet.

Each time the shaving instrument 10 is utilized, the sensor detects water and triggers a timer 12 as shown in FIG. 5. The timer is connected to the LCD driver 14, also an off the shelf part, numerous types of which are available to those of ordinary skill in the art.

When sensor 5 becomes wet, it signals timer 12 which is, in the present example, a four hour counter. After a several millisecond delay, the output of timer 12 changes from a "1" to a "0". Due to the delay, there is a several millisecond period during which the output from timer 12 and sensor 5 are both high. When both inputs to logic 13 are high, the count is incremented.

After the delay, the output from timer 12 goes low for four hours, so that the count can not be incremented for four more hours. The timer will not change its output, even if the sensor 5 becomes wet again during this four hour period.

Logic means 13 is arranged to signal LCD driver 14 to increment the count if and only if the following two conditions are met: (i) at least four hours has elapsed since the last time sensor 5 was initially wet, and (ii) sensor 5 becomes wet. Thus, once the shaver is utilized, the count will be increased, but it will not be increased each time the shaver is wet during the same use. Rather, at least four hours must elapse, during which the shaving instrument 10 will dry. Since the user is unlikely to shave more than once during any four hour period, the display will show the correct number of shaves for which the presently installed shaving blade 3 has been used. Reset switch 15 resets the count to zero when a new razor is installed.

It should be noted that many other arrangements can be employed for ensuring that the shaver does not keep incrementing its count each time it is wet. For example, the timer can be arranged so that it disables the water sensor for a four hour period after the water sensor is initially wet. Numerous other arrangements are possible as well.

As also shown in FIG. 5, each time switch 4 closes the circuit, the LCD driver 14 resets the display 2 to zero. Finally, FIG. 5 also depicts a permanent or a long life battery 7 for driving the electronics therein.

The above describes a technique for counting the number of shaves for which an interchangeable and disposable blade has been utilized. While the above describes the preferred embodiment of the invention, it is apparent that other modifications and/or additions are possible which also fall within the spirit and scope of the present invention. For example, the switch for resetting the display to zero and the sensor utilized to detect use of the shaving instrument 91 may be different from those described herein.

Additionally, an LED 52 can be installed which lights up when the maximum number of shaves is reached. The shaving handle 10 can be equipped with a button which allows the user to adjust the present count displayed on the LCD display. This feature could be useful if the shaving instrument 91 was inadvertently wet and its count incremented although it was not used for shaving. The device, if economical enough, can also be built into a disposable razor.

I claim:

1. A shaving instrument comprising:

a shaving blade;

a shaving handle connected to said shaving blade;

an electronic counting means mounted within said shaving instrument for counting the number of times said blade has been utilized for shaving; and means mounted within said shaving instrument for automatically detecting an activity performed after shaving is initiated by a user, and for automatically incrementing said counting means when said means for detecting indicates that said shaving instrument has been used to shave.

2. A shaving instrument according to claim 1 wherein said counting means includes an electronic counter and a Liquid Crystal Display (LCD).

3. A shaving instrument according to claim 2 wherein said detecting means includes a sensor for detecting when said shaving instrument is wet.

4. A shaving instrument according to claim 3 wherein said counting means comprises means for incrementing the count only when the sensor detects that the shaving instrument is wet and when the shaving instrument has not been wet for at least a predetermined amount time.

5. A shaving instrument according to claim 4 further comprising means for resetting the LCD to display a zero count when a shaving blade is initially installed.

6. A shaving instrument according to claim 5 wherein said means for resetting includes a plunger arranged to complete an electrical circuit when said shaving blade is installed onto said shaving handle.

7. A shaving handle for use with disposable shaving blades including:

a counter;

means for detecting the occurrence of an activity performed after shaving by a user has begun, and means responsive to said detecting means for incrementing said counter each time said means for detecting detects the occurrence of an activity performed after shaving by a user has begun.

8. The shaving handle of claim 7 further comprising:

a display; and means for displaying on the display a count that represents the total number of times the shaving handle has been used with a particular blade to shave.

9. The shaving handle of claim 8 further comprising means for allowing the user to alter the count displayed on the display.

10. The shaving handle of claim 9 further comprising a Light Emitting Diode (LED) for indicating that the count exceeds a predetermined value.

11. The shaving handle of claim 9 further comprising an audible alarm for indicating when the count exceeds a predetermined value.

12. The shaving handle of claim 7 wherein said means for detecting is a moisture detector.

13. A disposable shaving instrument including:

means for detecting the occurrence of an activity performed after shaving begins when the instrument is utilized by a user to shave, a counter, and means responsive to said detecting means for incrementing the counter each time said detecting means detects said occurrence.

14. The instrument claim 13 further comprising:

means for displaying a count that represents the total number of times the instrument has been used to shave.

15. The instrument of claim 14 further comprising means for allowing the user to alter the count displayed on the display means.

16. The instrument of claim 15 further comprising a Light Emitting Diode (LED) for indicating that the count exceeds a predetermined value.

17. The instrument of claim 15 further comprising an audible alarm for indicating when the count exceeds a predetermined value.

18. The instrument of claim 13 wherein said means for detecting is a moisture detector.

* * * * *